US009291039B2

(12) United States Patent
King et al.

(10) Patent No.: US 9,291,039 B2
(45) Date of Patent: Mar. 22, 2016

(54) SCINTERED POWDER METAL SHAPED CHARGES

(75) Inventors: Allan W. King, Manvel, TX (US); Richard Caminari, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 420 days.

(21) Appl. No.: 12/878,129

(22) Filed: Sep. 9, 2010

(65) Prior Publication Data

US 2011/0056691 A1 Mar. 10, 2011

Related U.S. Application Data

(60) Provisional application No. 61/241,083, filed on Sep. 10, 2009.

(51) Int. Cl.

| | |
|---|---|
| ***E21B 43/117*** | (2006.01) |
| ***F42B 3/28*** | (2006.01) |
| ***E21B 43/118*** | (2006.01) |
| ***B22F 3/12*** | (2006.01) |
| ***F42B 1/036*** | (2006.01) |
| *B22F 3/24* | (2006.01) |

(52) U.S. Cl.

CPC ..... *E21B 43/118* (2013.01); *B22F 3/1258* (2013.01); *F42B 1/036* (2013.01); *B22F 2003/242* (2013.01); *B22F 2998/10* (2013.01); *B22F 2999/00* (2013.01)

(58) Field of Classification Search

USPC ..... 175/4.6; 102/331, 306; 89/1.151

See application file for complete search history.

(56) References Cited

U.S. PATENT DOCUMENTS

| | | | | |
|---|---|---|---|---|
| 3,021,784 | A * | 2/1962 | Meddick | 175/4.6 |
| 3,079,861 | A * | 3/1963 | Charrin | 102/331 |
| 3,196,792 | A * | 7/1965 | Charrin | 419/29 |
| 3,793,920 | A * | 2/1974 | Sheran | 86/1.1 |
| 4,893,815 | A | 1/1990 | Rowan | |
| 5,814,758 | A * | 9/1998 | Leidel | 102/307 |
| 6,386,109 | B1 * | 5/2002 | Brooks et al. | 102/306 |
| 7,393,423 | B2 * | 7/2008 | Liu | 149/38 |
| 7,909,115 | B2 * | 3/2011 | Grove et al. | 175/4.6 |
| 7,987,911 | B2 * | 8/2011 | Rhodes et al. | 166/297 |
| 2005/0247450 | A1 * | 11/2005 | Ratanasirigulchai et al. | 166/297 |
| 2006/0266551 | A1 * | 11/2006 | Yang et al. | 175/4.6 |
| 2009/0038846 | A1 * | 2/2009 | Walker | 175/4.6 |

* cited by examiner

*Primary Examiner* — Kenneth L Thompson

(74) *Attorney, Agent, or Firm* — Jeffery R. Peterson

(57) ABSTRACT

A shaped charge includes a casing defining an interior volume, wherein the casing is prepared by sintering a metal powder or a mixture of metal powders; a liner located in the interior volume; and an explosive between the liner and the casing. A method for manufacturing a shaped charge casing includes the steps of mixing a metal powder or a metal powder mixture with a binder to form a pre-mix; pressing the pre-mix in a mold to form a casing green body; heating the casing green body to a first temperature to vaporize the binder; raising the temperature to a second temperature in an inert or reducing atmosphere to sinter the metal powder or the metal powder mixture to produce the shaped charge casing.

6 Claims, 5 Drawing Sheets

A

B

SCINTERED POWDER METAL SHAPED CHARGES

CROSS REFERENCE TO RELATED APPLICATIONS

The invention claims benefits of Provisional Application Ser. No. 61/241,083, filed on Sep. 10, 2009. This provisional application is incorporated by reference in its entirety.

BACKGROUND

1. Technical Field

The present application relates generally to perforating and more particularly to shaped charges having cases made with sintered metal powders.

2. Background Art

To complete a well for purposes of producing fluids (such as hydrocarbons) from a reservoir, or to inject fluids into the reservoir, one or more zones in the well are perforated to allow for fluid communication between the wellbore and the reservoir. Normally, perforation is accomplished by lowering a perforating gun string that has one or more perforating guns to the desired intervals within the well. Activation of the one or more guns in the perforating gun string creates openings in any surrounding casing and extends perforations into the surrounding formation.

A perforating gun typically includes a gun carrier and a number of shaped charges mounted to the gun carrier. The gun carrier can be a sealed gun carrier that contains the shaped charges and that protects the shaped charges from the external wellbore environment. Alternatively, the gun carriers can be on a strip carrier onto which capsule shaped charges are mounted. A capsule shaped charge is a shaped charge whose internal components are sealably protected against the wellbore environment.

One of the major problems facing designers of perforating guns for use in oil and gas wells may be the issue of gun survivability, especially, in guns, where charges are used in high shot densities. The causes of gun failure include the initiation of cracks on the interior gun wall caused by the impact of the shaped charge case fragments traveling at high speed and as a result of the high gas pressure generated by the explosion within the case.

Combination of the multiple impact sites and the high interior gas pressure can form centers of damages and initiate cracks in the gun wall, thereby compromising the integrity of the gun wall. Such a failure may rupture the gun and lead to costly retrieval of the destroyed gun from the well.

Another issue associated with the use of the conventional perforating guns is that the fragments, generated from the detonated cases, may damage the fluid circulation pumps or interfere with completion equipment. Furthermore, these fragments may restrict the flow of hydrocarbons through the perforations inside the wellbore casing.

Therefore, better shaped charges are needed to enhance gun survivability and protect downhole equipment.

SUMMARY

One aspect of preferred embodiments relates to shaped charges. A shaped charge in accordance with one embodiment includes a casing defining an interior volume, wherein the casing is prepared by sintering a metal powder or a mixture of metal powders; a liner located in the interior volume; and an explosive between the liner and the casing.

Another aspect relates to methods for manufacturing a shaped charge casing. A method in accordance with one embodiment includes the steps of: mixing a metal powder or a metal powder mixture with a binder to form a pre-mix; pressing the pre-mix in a mold to form a casing green body; heating the casing green body to a first temperature to vaporize the binder; raising the temperature to a second temperature in an inert or reducing atmosphere to sinter the metal powder or the metal powder mixture to produce the shaped charge casing.

Another aspect relates to methods for perforating a well. A method in accordance with one embodiment includes the steps of: disposing a perforating gun to a selected zone in a wellbore, wherein the perforating gun comprises at least one shaped charge, wherein the shaped charge comprises: a casing defining an interior volume, wherein the casing is prepared by sintering a metal powder or a mixture of metal powders, a liner located in the interior volume, and an explosive between the liner and the casing; and detonating the at least one shaped charge.

Other aspects and advantages of preferred embodiments will be apparent from the following description and the appended claims.

DETAILED DESCRIPTION

Embodiments relates to shaped charges having casings made of sintered metal powders. Embodiments also relate to methods for designing and manufacturing sintered powder metal casings for shaped charges and the use thereof.

Figure 1:
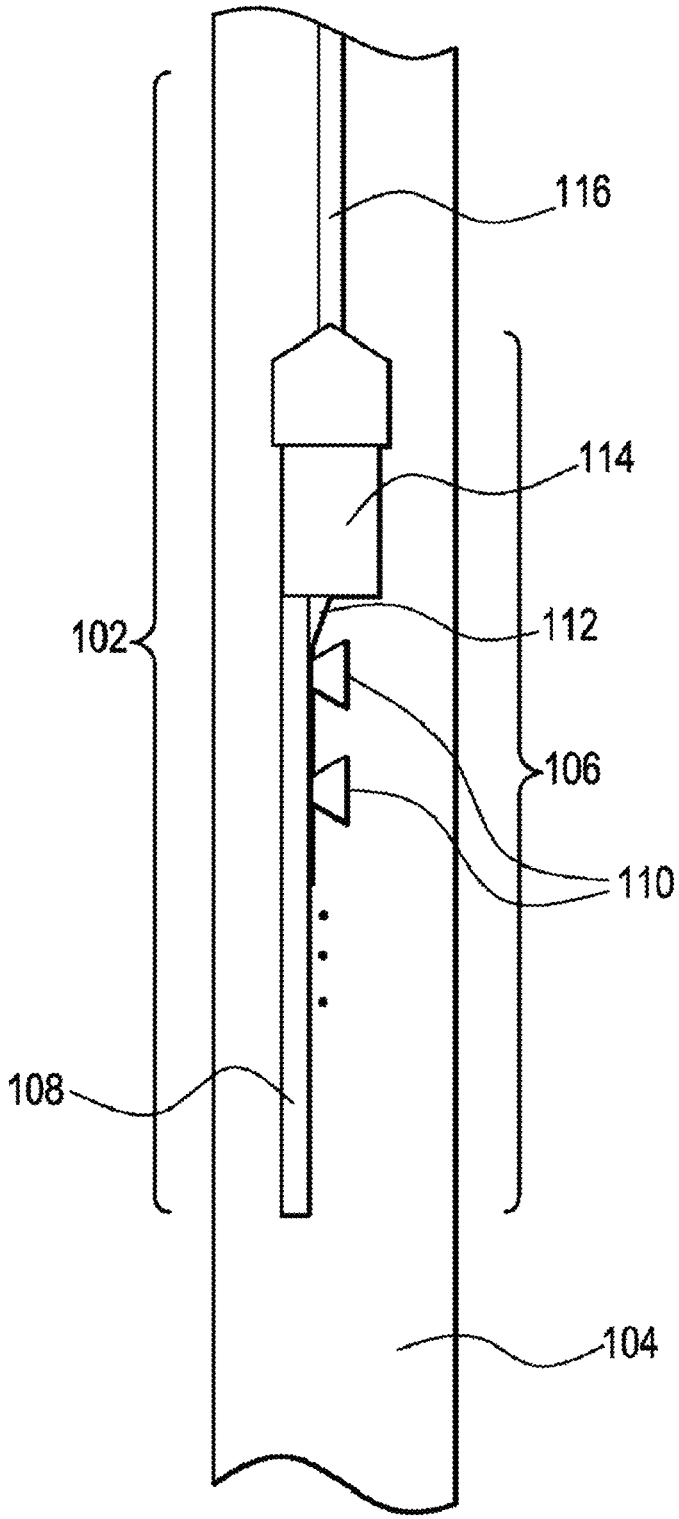
FIG. 1 shows a perforating gun with shaped charges disposed in a wellbore in accordance with one embodiment.

FIG. 1 illustrates a tool string 102 deployed in a wellbore 104. The tool string 102 includes a perforating gun 106 that has a carrier 108 having various shaped charges 110 (e.g., perforator charges or other explosive devices that form perforating jets) attached thereto. The perforating gun 106 is carried by a carrier line 116, which can be a wireline, slickline, coiled tubing, production tubing, and so forth. The carrier 108 may be an expendable carrier that is designed to shatter as a result of detonation of the shaped charges 110. An example of such an expendable carrier is a strip carrier, such as a carrier formed of a metal strip. In a different implementation, instead of mounting the shaped charges 110 on a strip carrier, the carrier can be a seated housing that has an inner chamber in which the shaped charges are located, with the chamber being sealed against external wellbore fluids in the wellbore 104.

In the embodiment shown in FIG. 1, the shaped charges 110 are provided in a sealed chamber of a carrier housing.

Therefore, the shaped charges 110 are non-capsule shaped charges. In alternative embodiments, when the shaped charges 110 are mounted to the carrier strip 108 such that the shaped charges 110 would be exposed to wellbore fluids, the shaped charges 110 are capsule shaped charges that have a capsule to provide a fluid seal to protect internal components of the shaped charges 110 against the wellbore fluids.

The shaped charges 110 in the example of FIG. 1 are ballistically connected to a detonating cord 112. The detonating cord 112 is connected to a firing head 114. When activated, the firing head 114 initiates the detonating cord 112, which in turn causes detonation of the shaped charges 110.

In a different implementation, the detonating cord 112 can be replaced with one or more electrical wires connecting the firing head 114 to the shaped charges 110. Electrical signal(s) can be sent by the firing head 114 over the one or more electrical wires to activate the shaped charges 110. For example, the shaped charges 110 can be associated with electrically-activated initiators (e.g., electrical foil initiators or EFIs), which when activated by an electrical signal causes initiation of a detonator or explosive to detonate the corresponding shaped charge 110.

In accordance with some embodiments, a shaped charge 110 has an outer casing that is formed of sintered metal powders. When exploded, the sintered metal powder casing would produce finer particles or debris, which would cause less damages to a perforating gun.

Figure 2:
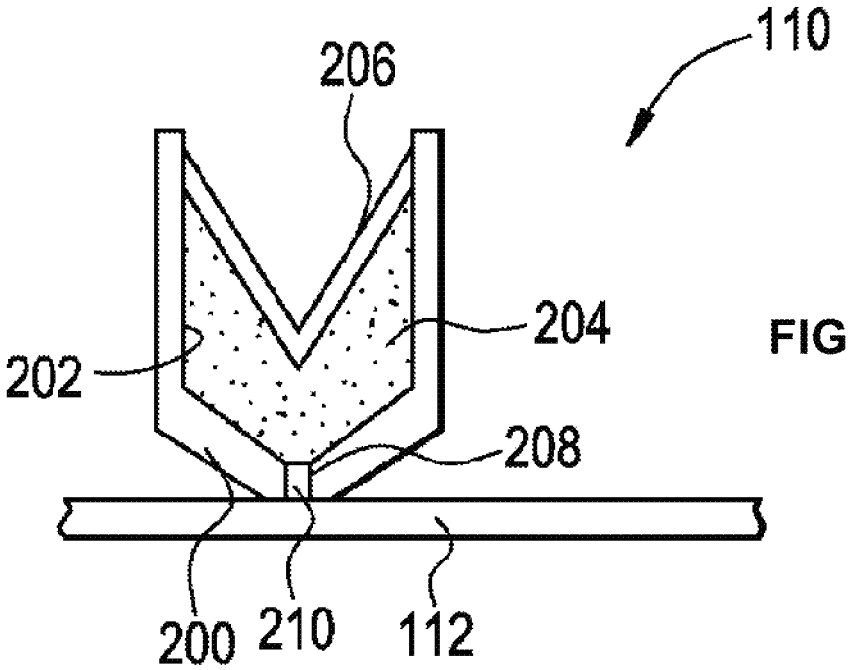
FIG. 2 shows a shaped charge in accordance with one embodiment.

FIG. 2 shows an example shaped charge 110 that has a casing 200. The outer casing 200 defines an inner chamber 202 to receive a main explosive 204. Also, a liner 206 is provided inside the outer casing 202, where the liner 206 generally has a generally conical shape. The conical shape of the liner 206 provides for a deeper perforation hole. Alternatively, the liner 206 can have a different shape, such as a general bowl shape, which would allow for creation of larger holes. The main explosive 204 is provided between the liner 206 and the inside of the casing 200.

As further depicted in FIG. 2, an opening 208 at the rear of the casing 200 allows for an explosive material portion 210 to be provided, where the explosive material portion 210 is ballistically coupled to the detonating cord 112 to allow for the detonating cord 112 to cause the explosive material portion 210 to detonate, which in turn causes the main explosive 204 to detonate. Detonation of the main explosive 204 causes the liner 206 to collapse such that a perforating jet is formed and projected away from the shaped charge 110. The perforating jet is directed towards the structure (e.g., casing and/or surrounding formation) in which a corresponding perforation tunnel is to be formed.

Upon detonation of the main explosive 204, a large amount of heat and pressure is generated in a very short period of time. This sudden surge of pressure and heat may cause the casing 200 to disintegrate, generating fragments and debris. Such fragments or debris would be hurled with high speed to impact the perforating gun housing.

Figure 3:
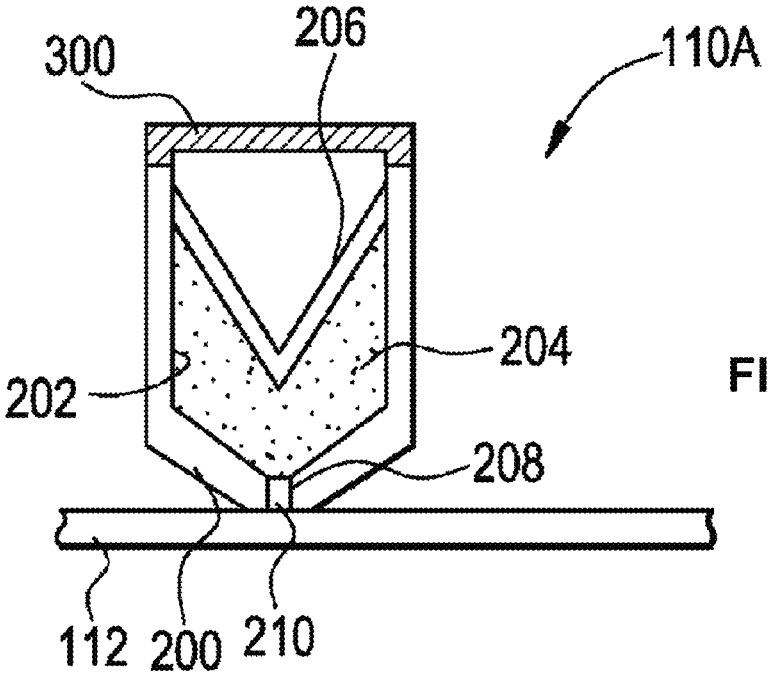
FIG. 3 shows a capsule shaped charge in accordance with one embodiment.

FIG. 3 shows an alternative embodiment of a shaped charge, identified as 110A. The shaped charge 110A is identical in construction with the shaped charge 110 of FIG. 2, except that a cap 300 is also provided in the shaped charge 110A to sealably engage with the casing 200, where the cap 300 allows for the internal components of the shaped charge (liner and explosive material) to be protected from the external wellbore environment.

Effectively, the cap 300 and casing 200 form a capsule that sealably defines a sealed inner chamber containing the internal components of the shaped charge. The shaped charge 110A is a capsule shaped charge, whereas the shaped charge 110 of FIG. 2 is a non-capsule shaped charge.

In accordance with embodiments, the casing 200, as shown in FIGS. 2 and 3, can be formed of a sintered metal power, using suitable sintering techniques. In general, the metal powders, together with one or more binders, are first formed into a green body having the desired casing shape. Then, the green body is heated at a suitable temperature to vaporize the binder materials and volatile materials. Finally, the temperature is raised to a temperature high enough to cause sintering of the metal powders.

Figure 4:
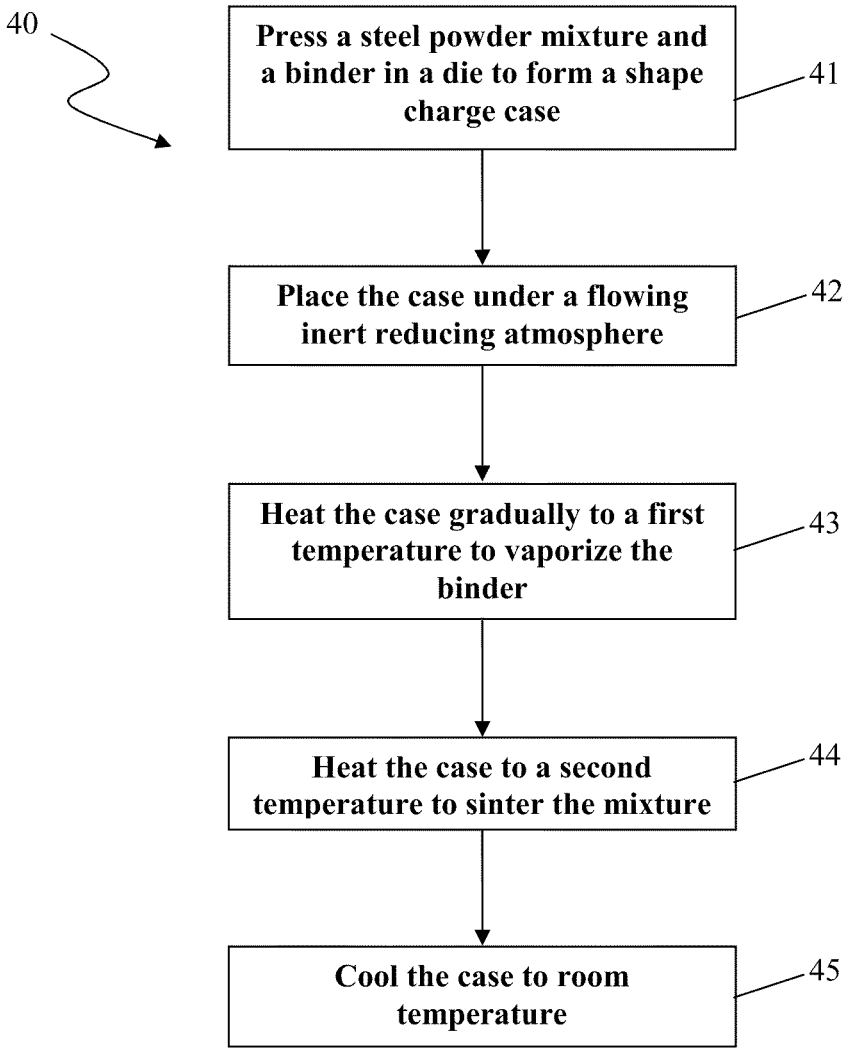
FIG. 4 shows a method of manufacturing a sintered metal powder shaped charge casing in accordance with one embodiment.

FIG. 4 shows a method 40 for manufacturing a sintered metal powders casing of a shaped charge in accordance with one embodiment. A forming die of a shaped charge casing may be used to make a "green body" of sufficient strength to withstand normal handling in the manufacturing processes. This may be accomplished by mixing a metal powder (or a mixture of metal powders) with one or more binders to form a pre-mix and then pressing the pre-mix in the die under high pressure (step 41). The mixing of the metal powder (or the mixture of metal powders) may be performed in the die (or mold).

The metal powders may be steel powders or a mixture formulated to provide a unique combination of strength, density, and/or fracturability. For example, carbon may be incorporated into steel powder to achieve high fracturability. In accordance with other embodiments, copper or other metals, including (but not limited to) tin, zinc, tungsten, may be added to the steel powder to achieve high density.

The green body of the shaped charge casing may then be placed in an inert or reducing atmosphere (step 42), such as nitrogen/hydrogen, which may be a stream flowing over the green body. The green body may be gradually heated to a modest temperature, e.g., ~300-500° C., to slowly vaporize the binders and/or other volatile components (step 43). These binders and/or other volatile components are used to provide sufficient strength to the green body for easy handling. After the binders and/or other volatile components are vaporized, the temperatures may be raised to a suitable temperature for a proper duration to cause the metal powders to be sintered together. One skilled in the art would appreciate that the temperatures and durations for sintering would depend on the compositions of the powders and/or the shapes and sizes of the green bodies. Typical sintering temperature for steel powders may be around 1000° C. or higher, e.g., ~1150° C. The duration may range from minutes to many hours, typically round a few hours (step 44). Once the metal powder is sintered, a strong solid body (shaped charge casing) would be formed. At the end of the sintering process, the shaped charge casing may be allowed to cool in an inert atmosphere to room temperature (step 45). Finally, the shaped charge casing made of sintered metal powders may then be loaded with explosives and liners according to the techniques known in the art.

EXAMPLES

In accordance with embodiments, a steel powder mixture, for example, may include powdered steel (such as Ancorsteel® 1000B from Hoeganaese Corporation, Riverton, N.J.), a suitable amount of carbon (such as ~0.01-5% or more of graphite, depending on the desirable characteristics of strength/brittleness), one or more binders (such as a wax, for example, 0.25-2.75% of Acrawax® C from Lonza, Basel, Switzerland), and, if necessary, ~0.05-1.5% of mineral oils, which may be used as a binder and dust suppressant.

In one example, a powder steel mixture may include steel powders and tin powders, zinc powders, or a mixture of copper with tin and/or zinc (i.e., bronze or brass alloy). In another example, a steel powder mixture may include 80-90% steel powder and 10-20% of the tin, zinc, brass and/or bronze.

In accordance with some embodiments, a steel powder mixture may also include other metals, for example, to increase the density of the steel casing to produce increased confinement of the explosive charges. A sintered metal powder casing typically has a normal density of around ~6.8 gm/cc, comparable to that of a solid steel machined case (7.8 gm/cc). If desired, the density of a sintered steel powder casing may be increased to above 7.8 gm/cc by adding materials, such as tungsten, copper, and other metals. A higher density casing may provide a high degree of confinement to enhance shaped charge performance, e.g., enhanced penetration tunnel sizes and/or lengths into the formation. Such casings may be used for special applications, such as small high performance casing or ultra-deep penetrators.

In addition, the properties of a sintered metal powder casing can be easily altered. For example, the hardness of sintered metal powder casings can be altered by steam treatments with an impervious coating of bluish-black iron oxide to seal the pores of the cases.

In accordance with embodiments, these steel powders or mixtures may be pressed in a mold (or die) to form a shaped charge casing "green body." After the casing green body is formed, the green body may be removed from the die. The "green casing" may then be gradually heated to a suitable temperature, e.g., ~300-500° C., in an inert reducing atmosphere, to vaporize the minor components, such as binders and/or mineral oils. The temperatures may then be raised to a temperature high enough to cause the metal powders to sinter, e.g., ~1150° C. (or other suitable temperature), in an inert reducing atmosphere, which may comprise a flow of, for example, ~90% nitrogen and 10% hydrogen.

Sintering causes the steel powder particles and/or other metal powders or particles to bind (fuse) together. The sintering temperatures may vary depending on the type of metals used. One skilled in the art would appreciate that the sintering points may be estimated from phase diagrams. Finally, the shaped charge casings may be allowed to cool to room temperature and loaded with an explosive and liner using any conventional techniques.

Figure 5:
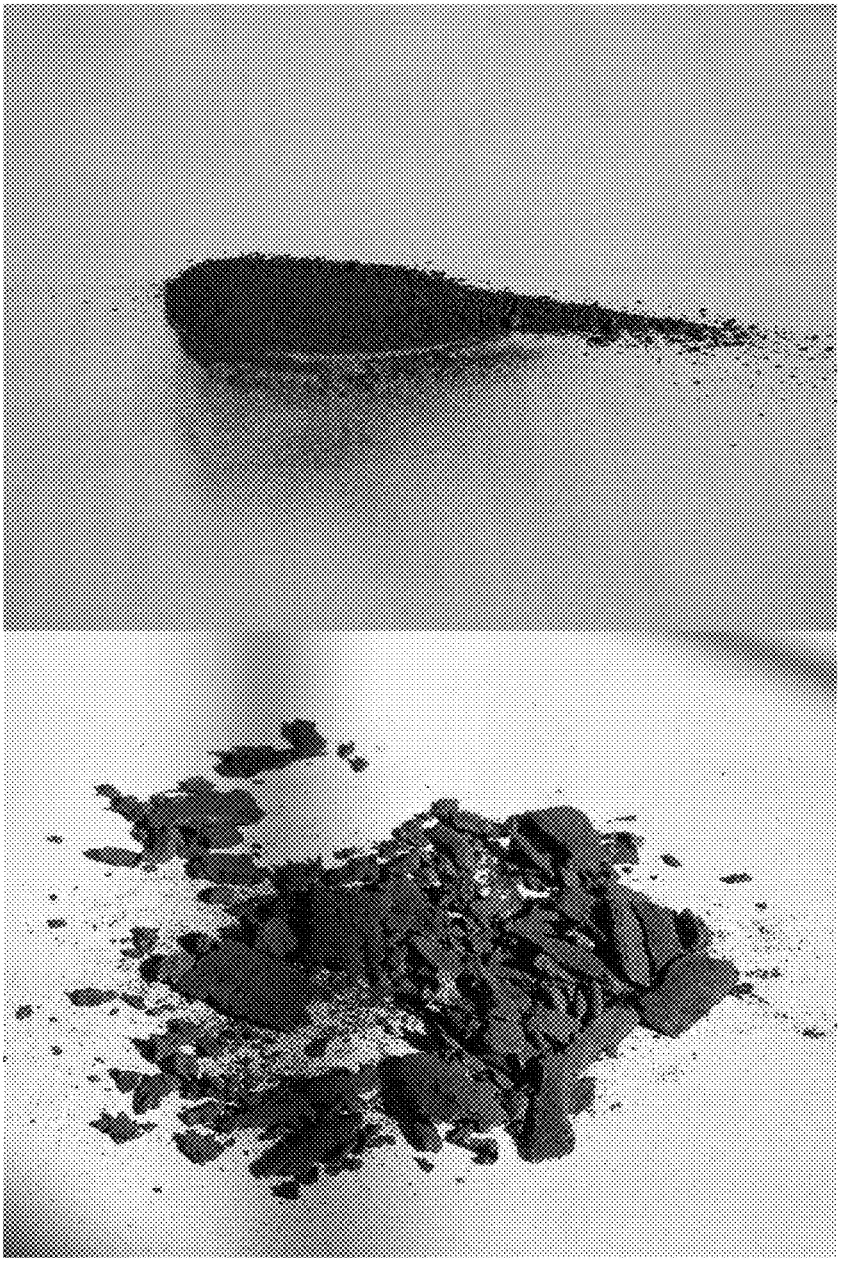
FIG. 5 shows (A) the powder debris of a shaped charge casing after explosion in accordance with one embodiment; and (B) the debris and fragments of a conventional shaped charge casing after explosion.

Being made of sintered metal powders, shaped charge casings in accordance with embodiments are expected to produce finer particle debris. For example, FIG. 5A shows that the debris produced by shaped charge casings according to preferred embodiments after detonation are fine powders or fine particles. In contrast, FIG. 5B shows that the debris produced by detonation of a conventional shaped charge casing, which is a machined steel casing, comprise much large fragments.

Because debris from shaped charge casings are fine particles, they will impact the gun wall with less damaging force. As a result, use of these casings can improve perforating gun survivability.

Figure 6:
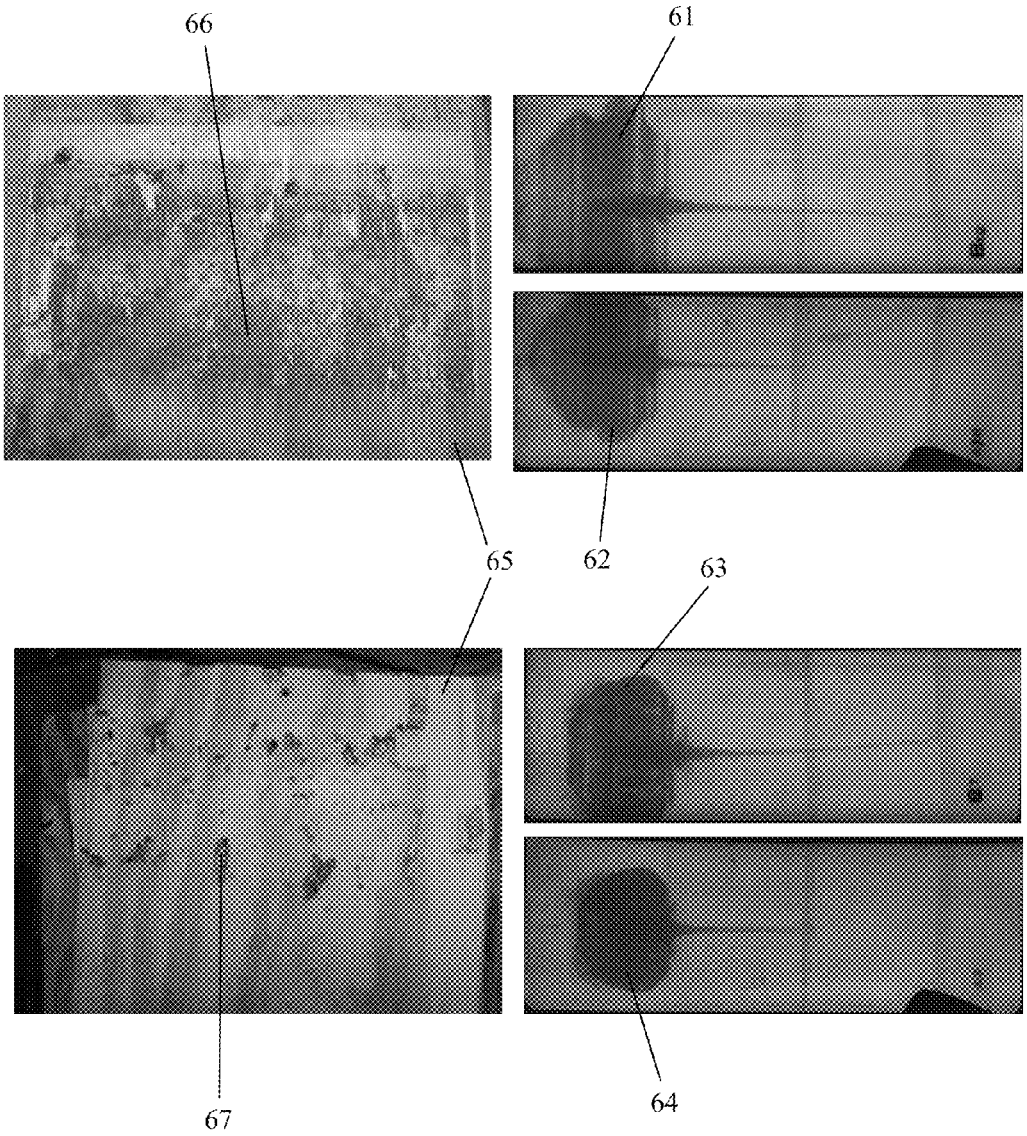
FIG. 6 shows the effects of detonation of shaped charges in accordance with embodiments of the invention, as compared with conventional shaped charges.

FIG. 6 shows, with flash X-Ray, the debris clouds 61, 62 produced by sintered metal powder casings in accordance with embodiments. The debris clouds 61, 62 contain fine particles. In contrast, the debris clouds 63, 64 and shards of metal are produced by a conventional machined steel casing.

FIG. 6 also shows shrapnel damage 67 on plywood 65 caused by detonation of a conventional machined steel casing. The damages manifest themselves as significant indentations distributed over the plywood. In contrast, the damages caused by a sintered metal powder casing show more evenly distributed powder spray pattern 66.

The powder-spray damages 66 are shallower indentations distributed over the surface of the plywood. It is apparent that these minor indentations are less likely to form damage centers that can lead to cracks of the object. In addition, the spray of fine particles produced by a sintered metal powder casing may attenuate the outgoing shock wave generated from the explosion. Together, these properties suggest that a sintered metal powder casing would cause less damages to a perforating gun than would a conventional machined steel casing.

Consistent with the above predictions, gun swell tests have shown a similar correlation, i.e., sintered metal powder casings cause less swell to perforating guns than their machined steel counterparts would at equivalent shot densities.

Advantages of the powder metal casings in accordance with the embodiments may include one or more of the following. Debris produced by a sintered metal powder casing are finer particles. This would avoid the formation of damage centers that might lead to cracks on perforating gun wall. The density of a sintered metal powder casing can be easily altered by mixing in proper metals. This would reduce the production costs and make such casings more readily available. From a manufacturing perspective, only a sufficient amount of metal powders is used. This would reduce the costs, as compared to the making of machined steel cases, because no waste or secondary machining is involved. In addition, the properties of a sintered metal powder casing can be easily altered. For example, the hardness of sintered metal powder casings can be altered by steam treatments with an impervious coating of bluish-black iron oxide to seal the pores of the cases. This would have an advantage over the traditional zinc plating of a machined casing because iron oxide is non-reactive and not easily worn off.

While preferred embodiments have been described herein, those skilled in the art, having benefit of this disclosure, will appreciate that other embodiments can be devised which do not depart from the inventive scope of the application as disclosed herein.

The invention claimed is:

1. A shaped charge, comprising:

a sintered metal powder casing defining an interior volume, wherein the casing comprises a mixture of sintered metal powders comprising steel powder at 80-90% and an additive comprising 10-20%, wherein further the casing comprises a coating of iron oxide;

a liner located in the interior volume; and an explosive between the liner and the casing.

2. The shaped charge of claim 1, wherein the metal powder comprises steel powder.

3. The shaped charge of claim 1, wherein the additive is carbon or graphite.

4. The shaped charge of claim 1, wherein the additive is at least one selected from the group consisting of tin powder, zinc powder, brass powder, and bronze powder.

5. The shaped charge of claim 1, wherein the additive is a mixture of tungsten and nickel or a mixture of tungsten and cobalt.

6. The charge of claim 1, further comprising a capsule.

* * * * *